US011825945B2

(12) United States Patent
Yang

(10) Patent No.: US 11,825,945 B2
(45) Date of Patent: Nov. 28, 2023

(54) SECURABLE WALL BRACKET

(71) Applicant: EOSEN LLC, Monterey Park, CA (US)

(72) Inventor: Zijiang Yang, Fontana, CA (US)

(73) Assignee: EOSEN LLC, Monterey Park, CA (US)

( * ) Notice: Subject to any disclaimer, the term of this patent is extended or adjusted under 35 U.S.C. 154(b) by 0 days.

(21) Appl. No.: 17/702,498

(22) Filed: Mar. 23, 2022

(65) Prior Publication Data

US 2023/0309695 A1 Oct. 5, 2023

(51) Int. Cl.
*A47B 95/00* (2006.01)
*A47B 57/40* (2006.01)

(52) U.S. Cl.
CPC ..... *A47B 95/008* (2013.01); *A47B 57/402* (2013.01); *A47B 57/404* (2013.01); *A47B 57/406* (2013.01)

(58) Field of Classification Search
CPC ..... A47B 95/008; A47B 57/40; A47B 57/402; A47B 57/404; A47B 57/406
See application file for complete search history.

(56) References Cited

U.S. PATENT DOCUMENTS 222,086 A * 11/1879 Slemmer ..... A47F 5/0846 24/328
3,734,436 A * 5/1973 Liberman ..... E04B 9/18 248/68.1
4,825,601 A 5/1989 Halverson
5,368,267 A * 11/1994 Howard ..... A47G 7/044 248/274.1
5,490,649 A * 2/1996 Kusalich ..... B23D 47/025 248/222.13
6,173,932 B1 * 1/2001 Poradzisz ..... B65B 13/025 100/11
6,811,043 B2 11/2004 Perkins et al.
7,055,703 B2 6/2006 Perkins et al.
8,070,118 B1 12/2011 Collins et al.
8,240,623 B2 8/2012 Collins et al.
8,800,212 B2 * 8/2014 Thrush ..... A47F 5/0846 52/36.5
9,365,150 B2 6/2016 Baldsiefen et al.

* cited by examiner

*Primary Examiner* — Ko H Chan

(57) ABSTRACT

A storage rack apparatus including a locking mechanism that secures a bracket (10) to a supporting member such as a wall-mounted rail (48) or panel (54). A securing bar (36) is rotatably attached to the body (12) of the bracket and is rotatable between unlocked (FIGS. 3 and 6) and locked (FIGS. 4, 5, 7, and 8) positions. In the unlocked position, an unlocking portion (44) of the securing bar does not make contact with the rail or panel. In the locked position, a locking portion (46) of the securing bar makes forced contact with a front surface (50, 62) of the supporting member, thereby placing the hooks (24, 26) of the bracket into frictional engagement with the rear surface (16) of the supporting member to resist movement of the bracket from its installed position.

13 Claims, 6 Drawing Sheets

SECURABLE WALL BRACKET

FIELD OF THE INVENTION

This invention relates generally to wall-mounted storage rack systems, and more particularly to a locking mechanism that secures a bracket to a wall-mounted rail or panel.

BACKGROUND OF THE INVENTION

Wall-mounted rack systems are known for storing various implements such as tools, clothing, cosmetics, musical equipment, hardware and other such items. A support structure, such as a slat wall panel or a slotted rail, is fastened to a wall to provide an upwardly facing support surface, e.g. the top surface of a wall panel or the bottom surface of a slot formed in a rail. The support surface serves to receive and to vertically support a downwardly opening hook of a bracket when the bracket is removably mounted to the support structure. The bracket, in turn, is used to hang an implement, either directly on the bracket or on a tool support such as a rod, hook, bin, basket, etc. attached to the bracket.

Typically, a wall-mounted rack system relies solely on the weight of the bracket to retain the bracket in its installed position on the support structure. This is sub-par for two reasons: (1) if there is no implement supported by the bracket, it is easy to accidently bump the bracket off of the support structure because the bracket is light and is easily dislodged; and (2) when there is a somewhat heavier implement being supported by the bracket, the bracket remains free to move vertically and horizontally relative to the support structure, making it less secure and inconvenient for the user, especially when the implement is fragile or is an item of great value and/or when the rack system is being used in a high vibration environment such as a factory.

U.S. Pat. No. 8,070,118 B1 attempts to address this problem by describing a wall-mount bracket for use with a slotwall support structure that includes a lever lock rotatably mounted to the bracket at a location just above the hook structure. After the bracket is hooked over the upwardly facing surface of a slot, the lever lock is rotated to a locked position where it protrudes into the slot to substantially fill the region of the slot above the hook, thereby limiting the vertical movement of the hook structure within the slot and preventing the bracket from being lifted out of the slot.

The present inventor has recognized a need for further improvement in wall-mounted rack systems. In particular, no known design provides adequate locking of a bracket into its installed position on a support structure. For example, while the device of U.S. Pat. No. 8,070,118 B1 described above does substantially limit the vertical movement of a bracket when mounted on the support structure and prevents the hook from being lifted out of the slot, it does not completely eliminate vertical movement, since at least some gap must necessarily remain above and below the lever lock to facilitate rotation of the locking member into and out of the slot. While this reduced amount of vertical freedom is beneficial in preventing the bracket from being accidently dislodged from the slot, it remains undesirable in some applications such as high vibration environments because it does not completely eliminate vertical movement of the bracket relative to the support structure. Moreover, the lever lock of the '118 patent does not limit horizontal movement of the bracket within the slot, which will result in the bracket "walking" along the slot when installed in a vibratory environment.

SUMMARY OF THE INVENTION

To overcome these limitations, the present invention provides a locking mechanism which applies a horizontal force to urge the hook structure of a wall-mount bracket against the back wall surface of the support structure, thereby generating frictional engagement between the bracket and the support structure effective to resist both vertical and horizontal movement of the bracket from its installed position.

Embodiments of the invention are described in the detailed description below and the accompanying drawings.

DETAILED DESCRIPTION OF THE INVENTION

Figure 1:
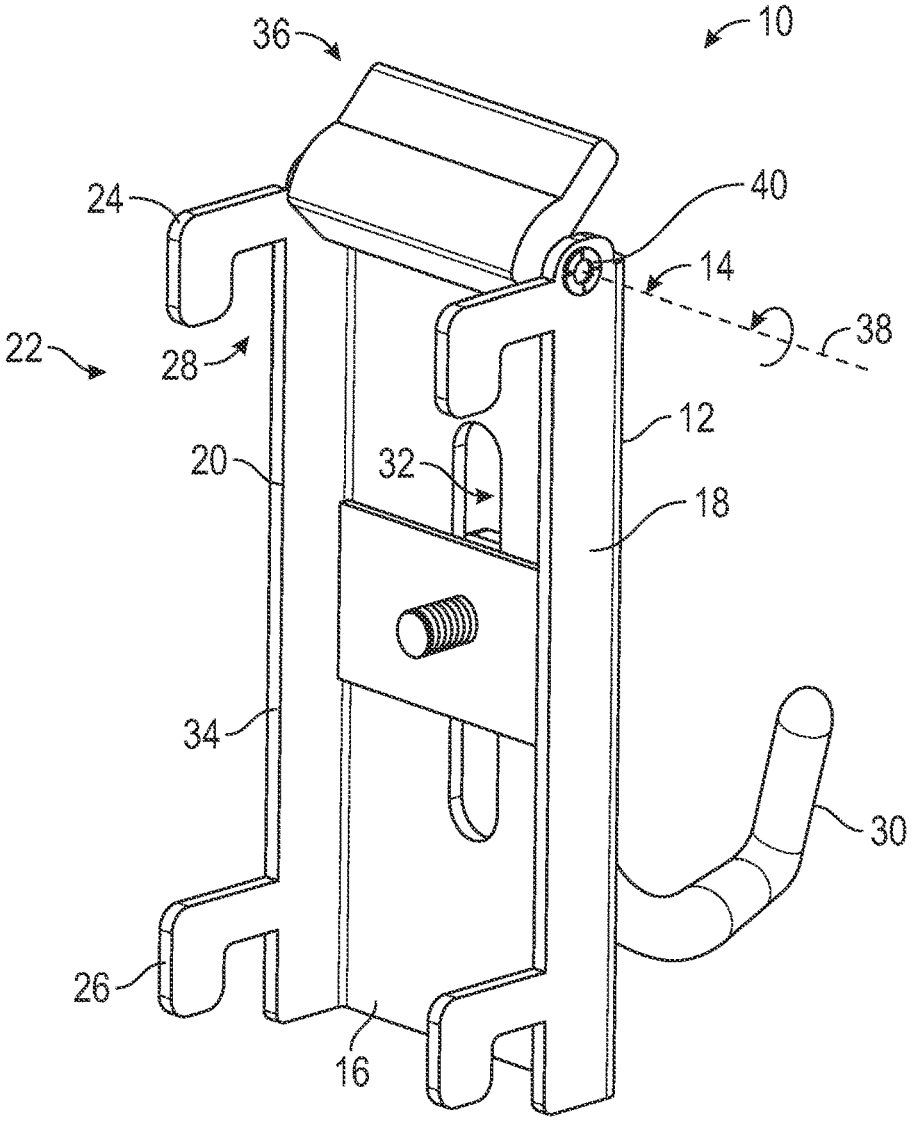
FIG. 1 is a rear perspective view of a bracket for a wall-mounted rack system.

FIG. 1 is a rear perspective view of a bracket 10 for a wall-mounted rack system in accordance with an embodiment of the invention. The bracket 10 includes a main body 12 having a front face or surface 14 (hidden in FIG. 1 but visible in FIGS. 2-4 described below), a rear surface 16, a first lateral side 18, a second lateral side 20 opposite the first lateral side 18, and a first (top) end 22. A pair of upper arm members 24 and a pair of lower arm members 26 extend rearwardly from the rear surface 16 of the main body 12 and form respective open notches 28 facing in a direction opposite said first end 22 to form downwardly opening hook structures. In various embodiments, the arm members 24, 26 may have various known inverted U, J or V shapes and may be referred to herein simply and generally as hooks 24, 26. Other embodiments of the invention may utilize only one or two or more hooks, depending upon the bracket design.

An implement such as a tool may be hung from the bracket 10 directly or may be hung from a forward supporting end of a tool support 30 which is supported by the bracket 10. In the embodiment of FIG. 1, a slotted opening 32 is formed in the main body 12 to have a longitudinal dimension generally parallel to the lateral sides 18, 20, so that a position of tool support 30 may be adjusted vertically by sliding an engaging member 34 along the slotted opening 32 to a desired position prior to tightening the engaging member 34 around a rear engaging end 31 (hidden in FIG. 1 but visible in FIG. 3 described below) of the tool support 30.

Bracket 10 also includes a securing member in the form of a securing bar 36 that is rotatably connected to the main body 12 along an axis of rotation 38 that is substantially parallel to the rear surface 16 of the main body 12. The securing bar 36 is used to exert a horizontal force to secure the bracket 10 in position on a support member, as described more fully below. The securing bar 36 is located proximate the first (top) end 22 of the main body 12, although in other embodiments other locations may be used to apply the horizontal force to any desired portion of the main body 12. Securing bar 36 may be rotatably connected to the main body 12 with a hinge pin 40 that extends through a first opening in the first lateral side 18, through a hole in the securing bar 36, into a second opening in the second lateral side 20 (holes and opening are hidden in the drawings but are easily understood by one skilled in mechanical arts). Alternatively, hinge pin 40 may be formed as a stub protruding from a longitudinal end of the securing bar 36 and through an opening formed in the body 12.

Figure 2:
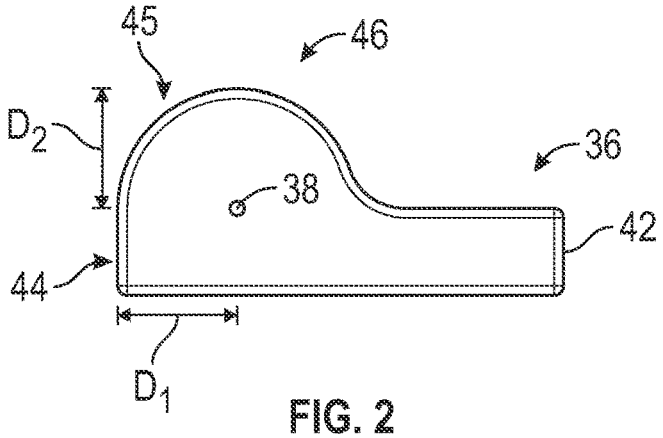
FIG. 2 is a side cross-sectional view of the securing bar of the bracket of FIG. 1.

FIG. 2 is a side cross-sectional view of the securing bar 36 of the bracket 10 of FIG. 1 which is useful in understanding the operation of the invention. Securing bar 36 includes a handle portion 42 which may have any shape useful for facilitating the application of force by a user in order to rotate the securing bar 36 between locked and unlocked positions about the axis of rotation 38. An unlocking portion 44 extends a first distance D1 in a first direction perpendicular to the axis of rotation 38. A locking portion 46 extends a second distance D2 greater than the first distance D1 in a second direction perpendicular to the axis of rotation 38. The cross-sectional shape of the securing bar 36 may include a tapering dimension between the first and second directions 45, such as one defining an elliptical or parabolic shape, in order to smooth the operation of the securing bar 36 as described more fully below. In the embodiment of FIG. 1, the cross-section of the securing bar 36 is constant along its longitudinal length, although in other embodiments the cross-sectional shape may vary along its length to accommodate various designs of brackets and support members. In some embodiments, the securing member may have limited or interrupted cross-sections along the axis of rotation 38, such as comprising one or more disks spaced along the axis of rotation 38 to exert identical or differing amounts of horizontal force onto the support member at one or more locations.

Figure 3:
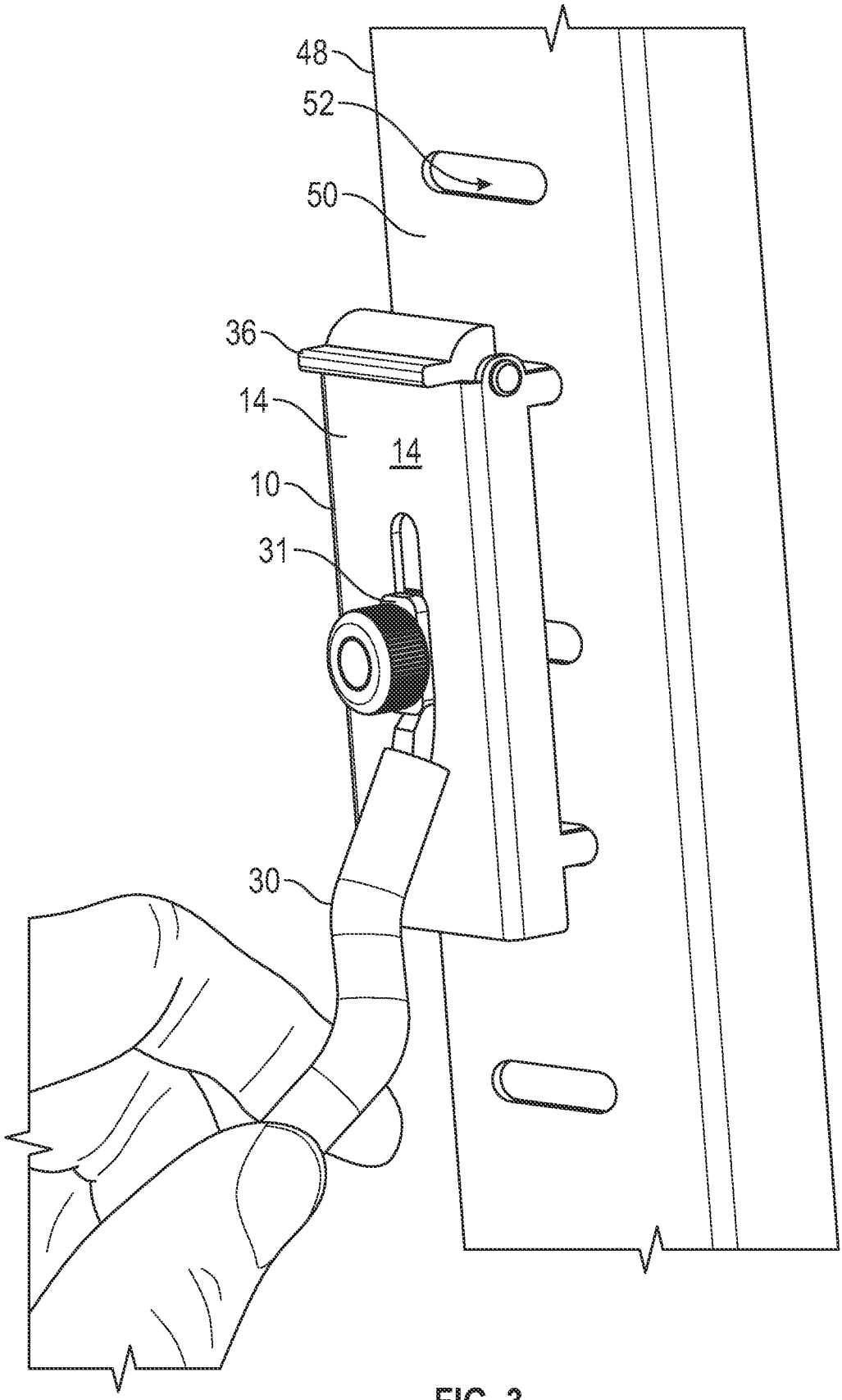
FIG. 3 illustrates the bracket of FIG. 1 installed on a support member in an unlocked configuration.
Figure 4:
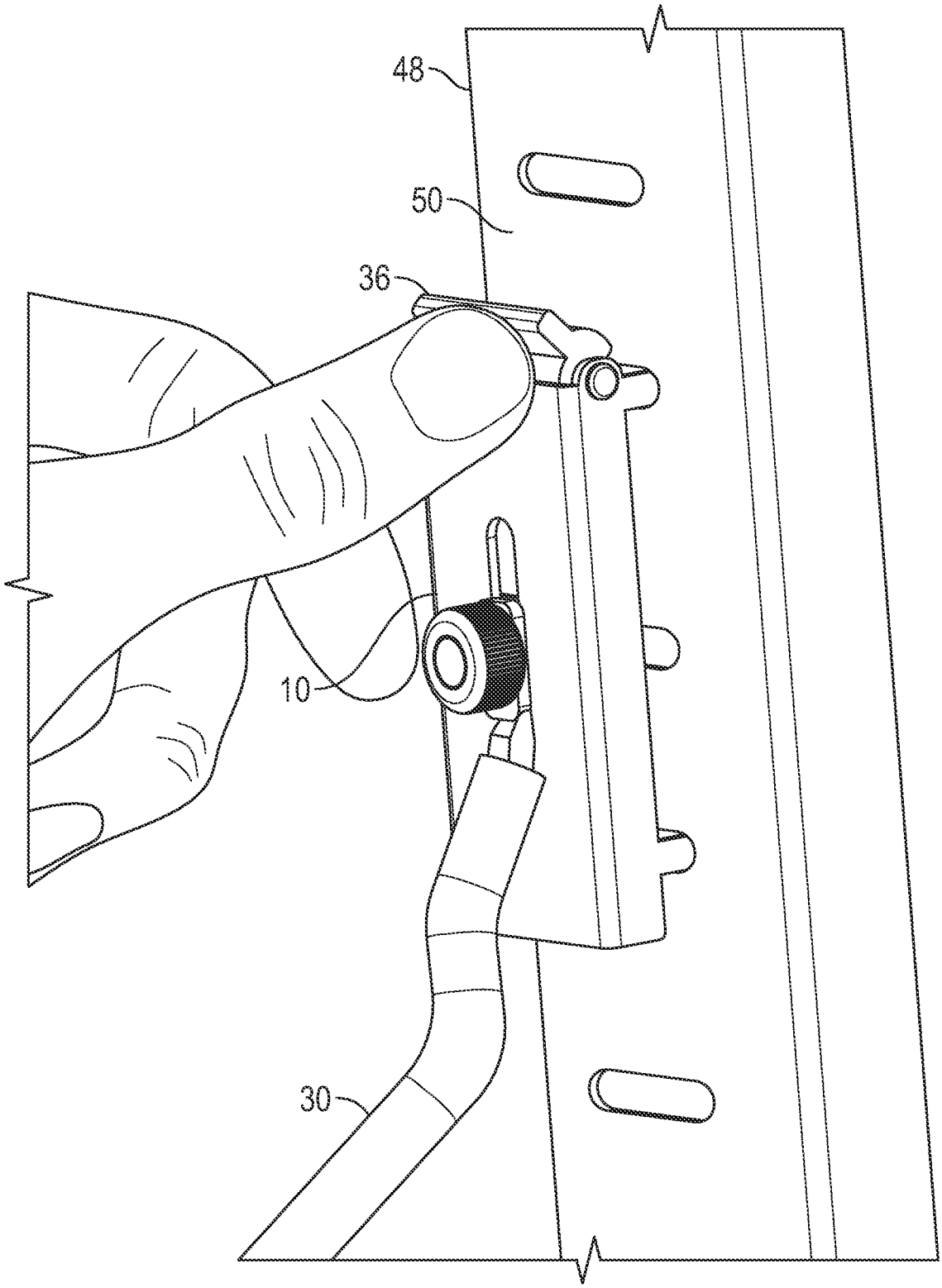
FIG. 4 shows the bracket of FIG. 1 installed on a support member in a locked configuration.

FIGS. 3 and 4 illustrate the bracket 10 of FIG. 1 in combination with, and installed on, a support member 48 to form a slotted rail tool storage system. FIG. 3 illustrates the bracket 10 of FIG. 1 installed on the support member 48 in an unlocked position where the unlocking portion 44 is positioned toward, but does not make contact with, a front surface 50 of the support member 48. FIG. 4 illustrates the bracket 10 of FIG. 1 installed on the support member 48 in a locked position where the locking portion 46 is positioned toward, and does make forced contact with, the front surface 50 of the support member 48. With the hooks 24, 26 of the bracket 10 positioned over respective upwardly facing bracket support surfaces 52 of the support member 48 to support the bracket 10 thereon, the first distance D1 is inadequate to allow the securing bar 36 to contact the front surface 50 of the support member 48 when the securing bar 36 is in the unlocked position, as illustrated in FIG. 3. However, when the securing bar 36 is rotated to the locked position, as shown in FIG. 4, the second distance D2 is adequate to allow the securing bar 36 to contact the front surface 50 of the support member 48, thereby urging the bracket 10 horizontally away from the support member 48. This urging, in turn, exerts a horizontal force between the downwardly extending portion of the hooks 24, 26 and the rear surface of the support member (not illustrated). This force causes frictional engagement between the bracket 10 and the support member 48, thereby resisting both vertical and horizontal movement of the bracket 10 from its installed position on the support member 48. Accordingly, embodiments of the present invention provide a more secure wall-mounted storage rack arrangement than prior art designs, and they are particularly advantageous for the storage of high value implements and/or in high traffic or high vibration applications.

Bracket 10 may be fabricated from known materials such as aluminum, steel, plastic, fiberglass, etc. The securing member may be formed as an elongated securing bar 36, as illustrated, or may have any other shape useful for a particular application and bracket design. The securing member may be made of any appropriate material, such as metal, wood, nylon, plastic, fiberglass, etc., with or without a coating material to achieve desired wear and friction characteristics, with consideration given to the amount of hook/support member frictional force desired for a particular design/application and the amount of rotational force required of the user in order to develop the desired friction. The design of the handle portion 42 of the securing member is likewise determined with due consideration for the convenience of the user to facilitate both locking and unlocking the device. A gradual tapering of the extending dimension (e.g. D1, D2) of the securing member 36 between the unlocking portion 44 and the locking portion 46 will provide a gradual increase in the required rotational force and the developed horizontal forces and friction as the securing member is rotated from the unlocked position to the locked position, thereby providing the user with a degree of control over the strength of the locking function.

Figure 5:
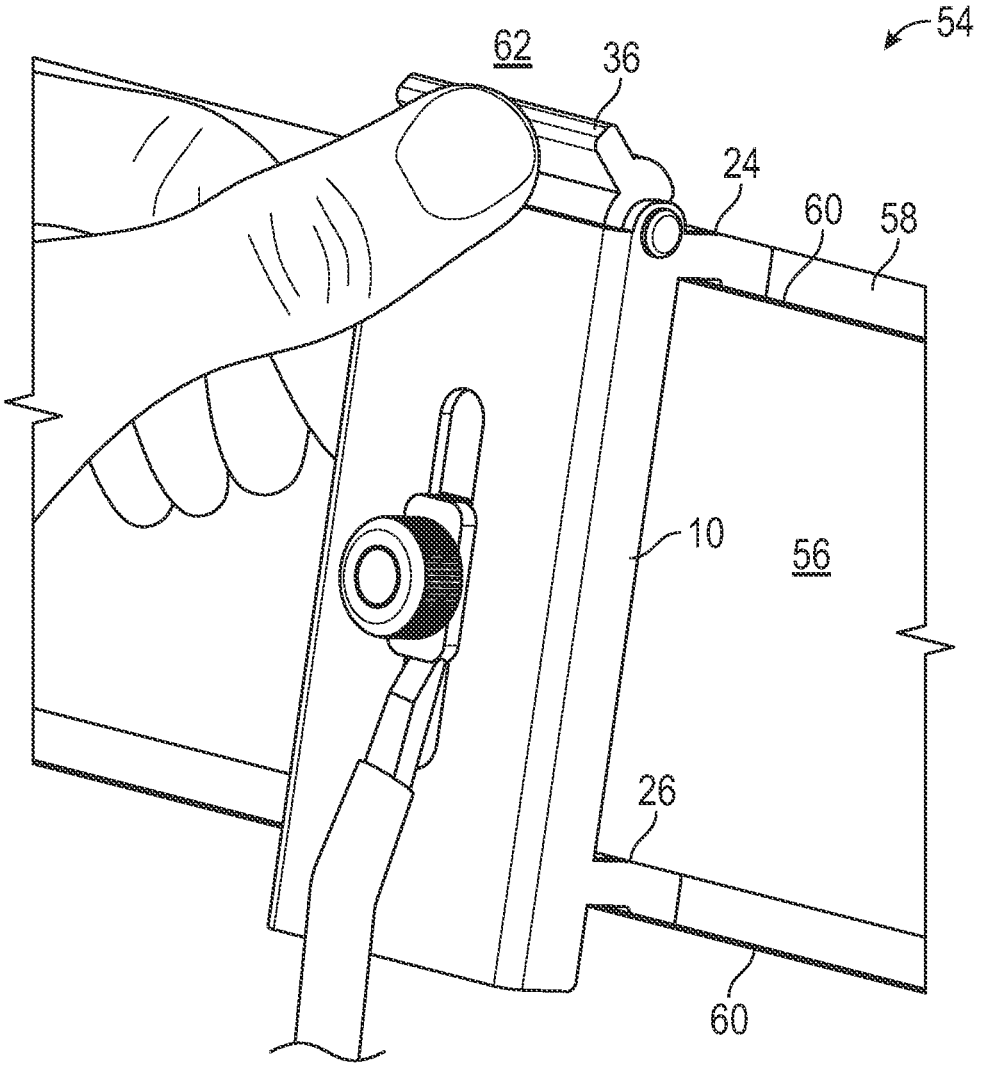
FIG. 5 depicts the bracket 10 of FIG. 1 installed on a slat wall.

FIG. 5 illustrates the bracket 10 of FIG. 1 installed in its locked position on a slat wall 54. Slat wall 54 consists of a plurality of slats 56 stacked vertically apart to define respective openings 58 there between. The top of each slat 56 presents an upwardly facing bracket support surface 60 configured to receive the hooks 24, 26 of bracket 10 when the bracket 10 is installed onto the wall 54. As in the embodiment illustrated in FIGS. 3 and 4, the securing bar 36 is configured to exert a horizontal force against the front surface 62 of wall 54 when it is rotated to its locked position, as illustrated, thereby generating frictional engagement between the hooks 24, 26 and the slats 56 to resist both horizontal and vertical displacement of the bracket 10 from its installed position on the wall 54.

Figure 6:
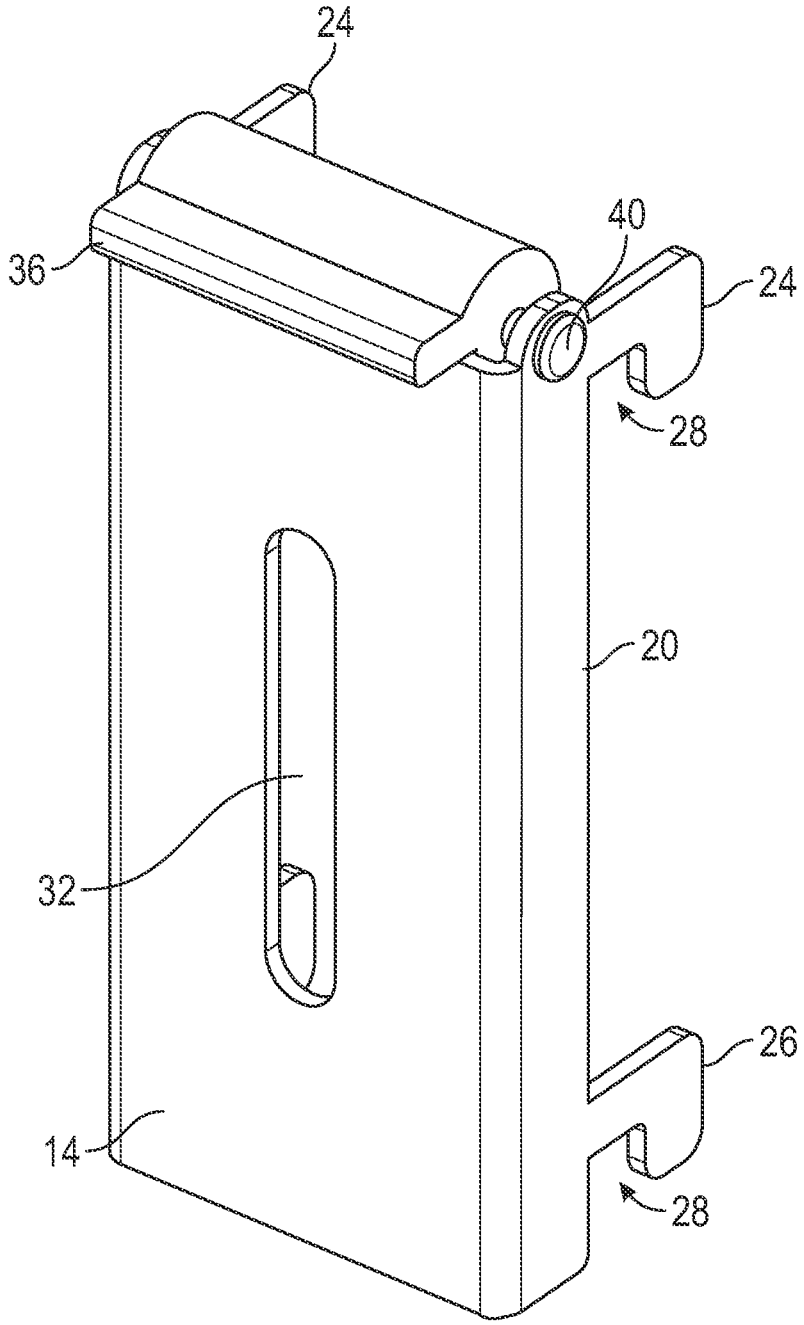
FIG. 6 is an isometric view of a bracket according to the invention.
Figure 7:
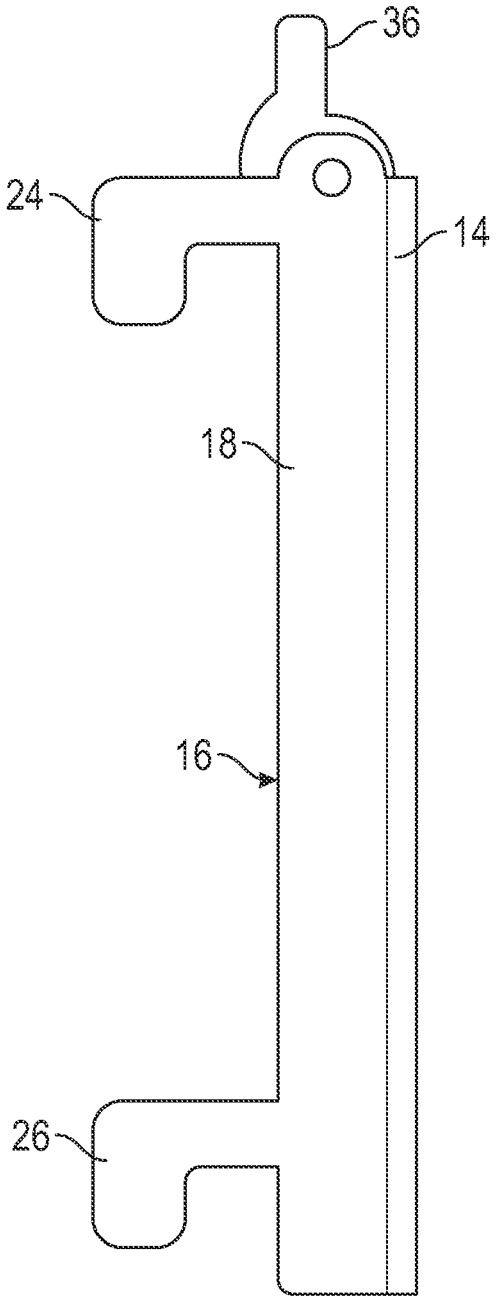
FIG. 7 is a first side view of a bracket according to the invention.
Figure 8:
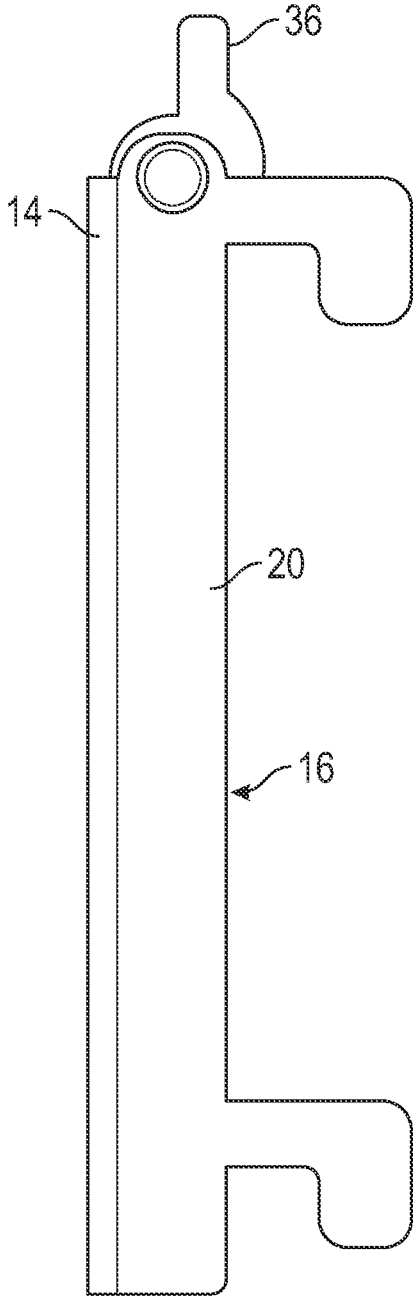
FIG. 8 is a second side view of a bracket according to the invention.

FIGS. 6-8 provide additional views of a securable wall bracket according to the invention. The same reference numbers are used for the same parts identified in other figures.

The present invention is universally useful on both original equipment brackets that are manufactured to include such a securing member, and for back fit applications where such a securing member is separately manufactured and is later installed onto an existing bracket. Such back fit securing members may be sold as part of a kit including the securing member and associated hardware and instructions necessary to install the securing member onto an existing bracket. The particular mechanical configuration of such back fit applications will depend upon the design of the bracket which is being upgraded, but any such differences from the embodiments described herein are well within the skill of a person familiar with the mechanical arts.

While various embodiments of the present invention have been shown and described herein, it will be obvious that such embodiments are provided by way of example only. Numerous variations, changes and substitutions may be made without departing from the invention herein.

What is claimed is:

1. A bracket configured for releasable attachment to a support member, the support member having a front surface, a rear surface and an upwardly facing bracket support surface extending there between, the bracket comprising:

a body comprising a front surface (14), a rear surface (16), a first lateral side (18), a second lateral side (20) opposite the first lateral side (18), a top end (22), a pair of upper arm members (24) that extend rearwardly from the rear surface (16) of said body and which form respective open notches (28) facing in a direction opposite said top end to form downwardly opening hook structures;

a downwardly opening hook extending rearward from the body and configured to vertically support the bracket when the hook is positioned over the upwardly facing bracket support surface; and a securing member rotatably attached to the body about an axis of rotation, the securing member further comprising:

an unlocking portion extending a first distance from the axis of rotation in a first direction, the first distance being insufficient to allow the securing member to make contact with the front surface of the support member when the hook is positioned over the upwardly facing bracket support surface and the securing member is rotated to an unlocked position, and a locking portion extending a second distance greater than the first distance from the axis of rotation in a second direction, the second distance being sufficient to allow the securing member to make contact with the front surface of the support member when the hook is positioned over the upwardly facing bracket support surface and the securing member is rotated to a locked position, the contact effective to exert a horizontal force between the hook and the rear surface of the support member for resisting relative motion between the bracket and the support member.

2. The bracket of claim 1, wherein the securing member further comprises a handle portion configured for receiving an application of force by a user to rotate the securing member between the locked and the unlocked positions.

3. The bracket of claim 2, wherein said bracket further comprises a pair of lower arm members (26) extend rearwardly from the rear surface (16) of the main body (12), and wherein the securing member has a locking portion that, when said securing member is rotated, allows the user to control a magnitude of the exerted horizontal force onto said support member.

4. The bracket of claim 1, further comprising:

a slotted opening formed in the body;

a tool support member comprising a forward supporting end and a rear engaging end; and an engaging member for selectively securing the rear engaging end of the tool support member at a selected position along the slotted opening.

5. The bracket of claim 1, wherein the securing member further comprises a securing bar rotatably connected to the body with a hinge pin that extends through an opening in the body.

6. The bracket of claim 1 in combination with a support member that comprises a slat wall panel.

7. The bracket of claim 1 in combination with a support member that comprises a slotted rail.

8. A locking mechanism for a bracket that connects to a wall-mounted implement support system having a support member, the bracket connecting to said support member by a rearwardly projecting, downwardly opening hook structure that engages over an upwardly facing support surface of the support member, the locking mechanism comprising:

a body configured for rotatable attachment to the bracket for rotation between an unlocked position where it does not make contact with a front surface of the support member, and a locked position where it does make forced contact with the front surface of the support member, the forced contact effective to generate frictional engagement between the hook structure and a rear surface of the support member to resist movement of the bracket relative to the support member.

9. The locking mechanism of claim 8, wherein the body further comprises:

an unlocking portion extending a first distance in a first direction perpendicular to an axis of rotation of the body relative to bracket; and a locking portion extending a second distance greater than the first distance in a second direction perpendicular to the axis of rotation.

10. The locking mechanism of claim 9, wherein the body further comprises a locking member that, when said securing member is rotated, exerts force on said support member.

11. The locking mechanism of claim 8 in combination with said wall-mounted implement support system, wherein said support system comprises a slat panel wall-mounted storage rack system.

12. The A locking mechanism of claim 8 in combination with said wall-mounted implement support system, wherein said support system comprises a slotted rail wall-mounted storage rack system.

13. A method of selectively securing a bracket onto a support member of a wall-mounted storage rack system, the bracket being removably installed on the support member by positioning a hook of the bracket over an upwardly facing bracket support surface of the support member, the method comprising:

rotatably attaching a locking mechanism to the bracket about an axis of rotation;

rotating the locking mechanism on the bracket to an unlocked position for installation/removal of the bracket from the support member, the locking mechanism making no contact with the support member when in the unlocked position; and rotating the locking mechanism to a locked position to secure the bracket in position on the support member, a locking portion of the locking mechanism extending a distance from the axis of rotation sufficient to make forced contact with a front face of the support member with the locking mechanism in the locked position, thereby generating a horizontal force there between and frictional engagement between the hook and a back face of the support member effective to resist both vertical and horizontal movement of the bracket from its installed position.

* * * * *